United States Patent [19]

Nomura et al.

[11] 4,120,719

[45] Oct. 17, 1978

[54] CEMENTED CARBONITRIDE ALLOYS CONTAINING TANTALUM

[75] Inventors: Toshio Nomura; Tsuyoshi Asai; Takaharu Yamamoto; Akio Hara, all of Itami, Japan

[73] Assignee: Sumitomo Electric Industries, Ltd., Japan

[21] Appl. No.: 747,689

[22] Filed: Dec. 6, 1976

[51] Int. Cl.[2] ..... B22F 3/00; C22C 29/00

[52] U.S. Cl. ..... 75/238; 75/242; 75/244; 75/203; 75/205

[58] Field of Search ..... 29/182.5, 182.7; 75/203, 205; 78/238, 242, 244

[56] References Cited

U.S. PATENT DOCUMENTS

| | | | |
|---|---|---|---|
| 3,752,655 | 8/1973 | Ramquist | 75/205 |
| 3,840,367 | 10/1974 | Rudy | 29/182.7 |
| 3,880,600 | 4/1975 | Zboril | 75/205 |
| 3,971,656 | 7/1976 | Rudy | 75/205 |
| 3,994,692 | 11/1976 | Rudy | 29/182.7 |
| 3,999,954 | 12/1976 | Kolaska et al. | 29/182.7 |
| 4,047,897 | 9/1977 | Tanaka et al. | 428/539.5 |
| 4,049,876 | 9/1977 | Yamamoto et al. | 75/241 |

*Primary Examiner*—Brooks H. Hunt
*Attorney, Agent, or Firm*—Wenderoth, Lind & Ponack

[57] ABSTRACT

The present invention relates to a hard cemented carbonitride alloy for cutting tools, which comprises 97 to 75% by weight of a hard phase and 3 to 25% by weight of a binder metal, the hard phase consisting of metallic components of titanium as a main component, 5 to 40% by weight of one or more of tungsten and molybdenum and 3 to 40% by weight of tantalum and non-metallic components of carbon and nitrogen, the proportion of nitrogen being 5 to 40% by weight of the non-metallic components and the binder metal being at least one element selected from the group consisting of iron, cobalt and nickel.

5 Claims, No Drawings

CEMENTED CARBONITRIDE ALLOYS CONTAINING TANTALUM

BACKGROUND OF THE INVENTION

1. Field of the Invention

The present invention relates to cemented carbonitride alloys containing titanium as a main component and tantalum, whose cutting property is markedly improved.

2. Description of the Prior Art

Titanium carbide base alloys of the prior art have hitherto been used for cutting tools excellent in wear resistance, in particular, for the high speed cutting of steels, because of not only their low production cost but also their excellent oxidation resistance at high temperatures and small chemical affinity to metals, but the scope of the intended use thereof is considerably limited because of the following three reasons. The first reason is that such a titanium carbide base alloy has a poor toughness and a tendency of breakage. It is known empirically that, when a tool is under the impulsive force of an interrupted cutting, etc., or when the rigidity of a machine tool is low, a titanium carbide base alloy is easier to break than a tungsten carbide base alloy of the prior art. The second reason by which the use of a titanium carbide base alloy is restricted is that deformation of an edge is large at a high temperature and high pressure. In a practical heavy cutting using an edge of titanium carbide base alloy, the edge meets an increase of temperature and a marked deformation and is not resistant to cutting. This is a main reason for the limited use of a titanium carbide base alloy to a light cutting operation. Furthermore, in the case of cutting a high hardness material, the temperature of an edge is markedly increased and, accordingly, a titanium carbide base alloy is not suitable for this case. The third disadvantage is that a titanium carbide base alloy is inferior to a tungsten carbide base alloy in thermal fatigue resisting property. Due to this disadvangage, a titanium carbide base alloy has not been used yet in operations with abnormal heat generations or loads, such as black cuttings or profiling cuttings varying in cutting depths, feeds, etc.

Various efforts have hitherto been made in order to overcome the above described three disadvantages. The latest proposal is to obtain a cemented carbonitride alloy of fine grain structure having an improved toughness and plastic deformation resistance at a high temperature by adding titanium nitride to titanium carbide base cermets of the prior art. In this alloy, the above described first and second disadvantages can be solved to some extent, but the third disadvantage is scarcely overcome. This constitutes a bar to the application of titanium carbide base or titanium carbonitride base cemented alloys to general use as a cutting tool.

SUMMARY OF THE INVENTION

It is accordingly an object of the present invention to provide an improved composition of material based on carbonitride alloys whereby the above described disadvantages can be overcome.

It is another object of the present invention to provide a cemented carbonitride alloy containing titanium as a principal component and tantalum, which exhibits a markedly improved cutting property.

It is a further object of the present invention to provide a new cemented carbonitride alloy having an improved thermal fatigue resistance.

These objects can be attained by a hard cemented carbonitride alloy for cutting tools, which comprises 97 to 75% by weight of a hard phase and 3 to 25% by weight of a binder metal, the hard phase consisting of metallic components of titanium as a main component, 5 to 40% by weight of one or both of tungsten and molybdenum and 3 to 40% by weight of tantalum and non-metallic components of carbon and nitrogen, the proportion of nitrogen being 5 to 40% by weight of the non-metallic components and the binder metal being at least one element selected from the group consisting of iron, cobalt and nickel. The percent used hereinafter should be taken as that by weight unless otherwise indicated.

DETAILED DESCRIPTION OF THE INVENTION

The most important feature of the present invention consists in a hard phase which comprises metallic components consisting of titanium as a predominant component, 5 to 40% of at least one element of tungsten and molybdenum and 3 to 40% of tantalum and non-metallic components consisting of carbon and nitrogen, the proportion of nitrogen being 5 to 40% based on the total amount of carbon and nitrogen, whereby to increase markedly the toughness, in particular, thermal fatigue resistance without lowering the wear resistance largely.

It has been found that the effects of tantalum are important and, in particular, tantalum serves to improve remarkably the thermal fatigue resistance that is the third disadvantage of the known cermets. The reason therefor is not clear, but it is assumed from the phenomenon that the mechanical strength is largely increased as described in Example 1 that tantalum serves to some extent to increase the wettability between a hard phase and a binder metal phase. Furthermore, there is a good chance that tantalum improves the thermal properties such as thermal conductivity, etc. The content of tantalum should be 3 to 40% based on the cemented carbonitride alloy since if more than 40%, not only the production cost of the alloy is increased, but also the hardness is too lowered to be put into practical use, while if less than 3%, the substantial effects cannot be expected.

In more detail, the effects of tantalum increase with the increase of the amount thereof, but, in view of that tantalum is an expensive element, the optimum range is between 40% and 60% by atomic ratio based on the total amount of tantalum, tungsten and molybdenum. In carbonitride base alloys, the importance of tantalum has not positively been confirmed and rather tantalum has been regarded as a harmful component, because, firstly, no one knows that the above described thermal fatigue resistance is very important and, secondly, a suitable method of adding tantalum has not been developed yet. In a previous attempt as disclosed in U.S. Pat. No. 3,971,656, tantalum is added in the form of a solid solution which tantalum forms with hard components of molybdenum and tungsten, for example, in the form of (Ti, Ta, Mo, W) (C,N). According to this method, however, the decomposition pressure of nitrogen is increased and nitrogen is released from the above described mixed carbonitride during sintering, resulting in that a high strength alloy cannot be obtained. On the other hand, it would be possible to add all the tantalum in the form of tantalum carbide (TaC), but, in this case, the solid solution forming reaction with other nitrides does not proceed sufficiently and consequently a low strength alloy is only obtained although there are some improvements in comparison with the former method. We, the inventors, have made an attempt, in consideration of the fact that the intrinsic nature of tantalum cannot be brought out by the above described addition method of tantalum, to add a part or all of tantalum in the form of a nitride or carbonitride that is relatively stable and has a low decomposition pressure, for example, $Ta(C,N)_Z$, $TaC_z + TaN_z$ (+TiN), (Ti, Ta) $(C,N)_z$, etc. where z is an atomic ratio of a non-metallic component to a metallic component, and consequently have found that the effects of tantalum can favourably be given by this addition method. For example, all the carbides and nitrides containing molybdenum and tungsten, corresponding to alloy D in Example 1, are subjected to a solid solution forming reaction by means of a hot press, crushed and sintered in the similar manner, thus obtaining an alloy having a transverse rupture strength of 130 $Kg/mm^2$, a flank wear width of 0.15 mm in a wear test and a thermal fatigue resisting property of 200 cycles to break down, which properties are inferior to those of Comparative Alloy O. This result is not inconsistent with that of U.S. Pat. No. 3,971,656.

Since niobium belongs to the same group of the Periodic Table as tantalum and has the similar properties thereto, a part of the tantalum can be replaced by niobium.

Tungsten or molybdenum, having effects of increasing the wettability between a hard phase and a binder metal phase, making finer the alloy structure and increasing the mechanical toughness, is incorporated in the alloy of the present invention in a proportion of 5 to 40%, since if more than 40%, the wear resistance is too lowered to be used practically and if less than 5%, the effects will substantially be lost. Furthermore, small amounts of refractory metals of Group, IVa, Va and VIa can be incorporated in the alloy of the present invention.

The non-metallic components are present in the hard phase in a proportion by atomic ratio of 0.8 to 1.0 times as much as the refractory metallic components such as titanium, tantalum, tungsten and molybdenum, since if more than 1.0 times the metallic components by atomic ratio, free graphite appears in the alloy and if less than 0.8 times, there appears a brittle phase such as $M_6(C,N)$ resulting in emblittlement of the alloy. Nitrogen serves to make finer the structure of the titanium carbonitride base cemented alloy together with tungsten or molybdenum as described above and to improve the toughness and the plastic deformation resistance at high temperatures, but if nitrogen is present in a proportion of more than 40% to the total amount of carbon and nitrogen, there take place some deterioration of the sintering property so that the alloy cannot be put to practical use and if less than 5%, the effects will substantially be lost. Therefore, the proportion of nitrogen in the non-metallic components should be 5 to 40%.

The predominant component of the metallic ones in the hard phase must be titanium so as to hold the excellent wear resistance of titanium carbide base or titanium carbonitride base cemented alloys. This means that titanium holds a predominant component in molar fraction and, in percent by weight, therefore, titanium holds a proportion of 20% or more to the metallic components in the hard phase.

In the cemented alloy of the present invention, moreover, one or more iron group metals are incorporated as a binder metal to raise the toughness in a proportion of 3 to 25%, since if more than 25%, the hardness is too lowered to be used practically, while if less than 3%, the object of incorporation thereof cannot be attained.

The alloy of the present invention is an alloy consisting mainly of a hard phase containing titanium, one or both of tungsten and molybdenum, tantalum, nitrogen and carbon and a binder metal phase containing one or more of iron, cobalt and nickel, which is free from decomposition of tungsten carbide and, as in the cemented alloys of the prior art, a part of the raw materials used in the form of WC, TaC, $Mo_2C$, TiC, etc. are diffused in the binder metal phase during sintering. That is to say, titanium, tantalum, tungsten, molybdenum, nitrogen and carbon are mainly present for the purpose of forming a hard phase having mainly B1 crystal structure, but there are some portions which do not take part in formation of such a hard phase. Therefore, these components will be defined by "metallic components and non-metallic components for forming mainly a hard phase" in the appended claims.

The present invention will be further illustrated in greater detail in the following examples and comparative examples in which percents are to be taken as those by weight unless otherwise indicated. The present invention is not to be interpreted as being limited thereby.

EXAMPLE 1

A commercially sold TiC powder having a mean grain size of 1 micron (total carbon : 19.70%, free carbon : 0.35%, real composition : $TiC_{1-x}$ wherein $x$ is 0 or less than 1), TiN powder having substantially the same grain size as TiC powder (nitrogen : 20.25%), WC powder (total carbon : 6.23%, free carbon 0.11%), $Mo_2C$ powder (total carbon : 5.89%, free carbon : 0.03%), Co powder passing through a 100 mesh sieve (Tyler standard sieve), Ni powder passing through a 287 mesh sieve, TaN powder having a grain size of 1.3 micron (nitrogen: 6.8%) and TaC powder having a grain size of 1.2 micron (total carbon : 6.20%, free carbon : 0.02%) were mixed according to the recipe as shown in Table 1 and ball milled with acetone for 96 hours in an 18-8 stainless steel lined pot using TiC-Ni-Mo balls having a diameter of 10 mm. The resulting mixed powders were respectively pressed at 2 $tons/cm^2$ with 3% of camphor and then sintered at 1380° C for 60 minutes in a vacuum of $10^{-3}$ mmHg to form alloys having mechanical properties as shown in Table 2 and cutting properties as shown in Table 3.

Table 1

| Alloy of This Invention | Recipe of Composition (%) | | | | | | | | Proportion of Ta in W + Mo + Ta (atomic %) |
|---|---|---|---|---|---|---|---|---|---|
| | TiC | TiN | TaN | TaC | $Mo_2C$ | WC | Ni | Co | |
| A | 38 | 18 | 5 | — | 9 | 15 | 5 | 10 | 13.5 |
| B | 44 | 5 | 12 | — | 15 | 9 | 10 | 5 | 24.2 |
| C | 35 | 13 | 15 | — | 10 | 12 | 5 | 10 | 32.6 |
| D | 28 | 10 | 15 | 12 | 6 | 14 | 7 | 8 | 51.6 |
| E | 22 | 8 | 14 | 12 | 7 | 24 | 7 | 6 | 41.2 |
| F | 40 | — | 20 | — | 10 | 15 | 7 | 8 | 37.0 |
| G | 37 | 13 | — | 20 | 10 | 5 | 7 | 8 | 45.6 |

100 Kg/cm² in a graphite mold to form a uniform solid solution and then crushed to give a grain size of about 1 micron. 61% of this powder was mixed with 15% of $Mo_2C$ powder, 9% of WC powder, 5% of Ni powder and 10% of Co powder used in Example 1 and subjected to the similar processing to Example 1 to prepare an alloy having a transverse rupture strength of 158 Kg/mm² and hardness of 1530 HV. The similar cutting test to Example 1 showed a flank wear width of 0.08 mm and a very small nose push and the similar thermal fatigue resistance test to Example 1 showed a breakage down at 1100 cycles.

EXAMPLE 3

In this example, an alloy corresponding to Alloy D in Example 1 was prepared. Firstly, TaN and Tac were held at a temperature of 1800° C and a pressure of 100 Kg/cm² for 10 minutes in a graphite mold to form Ta(CN), crushed in a grain size of −325 mesh, added to the composition for Alloy D of Example 1 in an amount corresponding to the total amount of TaC and TaN and then subjected to the similar processing to Example 1 to prepare the alloy having a transverse rupture strength of 180 Kg/mm² and a hardness of 1542 VHN. In the similar thermal fatigue resistance test, no breakage took place up to 1700 cycles.

EXAMPLE 4

The same starting powders as those of Example 1 were used, mixed according to the recipe of Table 4 and subjected to the similar procedure to Example 1 to prepare alloys having various properties shown in Table 5.

Table 4

| Alloy of This Invention | Composition (%) | | | | | | | | Proportion of Ta in |
|---|---|---|---|---|---|---|---|---|---|
| | TiC | TiN | TaN | TaC | $Mo_2C$ | WC | Ni | Co | W + Mo + Ta(atomic %) |
| H | 33 | 11 | 14 | 12 | 7 | 13 | 5 | 5 | 48.9 |
| I | 28 | 11 | 14 | 12 | 7 | 8 | 13 | 7 | 48.9 |

Table 5

| Alloy of This Invention | Transverse Rupture Strength (Kg/mm²) | Hardness (HVN) | Thermal Fatigue Resistance |
|---|---|---|---|
| H | 158 | 1620 | broken at 1200 cycles |
| I | 195 | 1460 | broken at 1900 cycles |

EXAMPLE 5

A commercially sold Tic powder having a mean grain size of 1 micron (total carbon: 19.70%, free carbon: 0.35%), TiN powder having substantially the same grain size as TiC powder (nitrogen: 20.25%), WC powder (total carbon: 6.23%, free carbon: 0.11%), $Mo_2C$ powder (total carbon: 5.89%, free carbon: 0.03%), Co powder passing through a 100 mesh sieve, Ni powder passing through a 287 mesh sieve and TaN powder having a grain size of 1.3 micron (nitrogen: 6.8%) were mixed according to the recipe as shown in Table 6 and ball milled with acetone for 96 hours in an 18-8 stainless steel lined pot using TiC-Ni-Mo balls having a diameter of 10 mm. The resulting mixed powders were respectively pressed at 2 tons/cm² with 3% of camphor and then sintered at 1380° C for 60 minutes in a vacuum of $10^{-3}$ mmHg to form alloys having mechanical properties as shown in Table 7.

Table 6

| Alloy of This Invention | Composition (%) | | | | | | | Proportion of Ta in |
|---|---|---|---|---|---|---|---|---|
| | TiC | TiN | TaN | WC | $Mo_2C$ | Ni | Co | W + Mo + Ta(atomic %) |
| J | 45 | 11 | 3 | 15 | 10 | 10 | 5 | 8 |
| K | 40 | 0 | 20 | 15 | 10 | 10 | 5 | 37 |
| Comparative Alloy | | | | | | | | |
| U | 45 | 15 | 0 | 15 | 10 | 10 | 5 | |
| V | 60 | 0 | 0 | 15 | 10 | 10 | 5 | |
| W | 25 | 35 | 0 | 15 | 10 | 10 | 5 | |

Table 7

| Alloy | Hardness (HV) | Transverse Rupture Strength (Kg/mm²) |
|---|---|---|
| J | 1600 | 155 |
| K | 1650 | 170 |
| U | 1570 | 150 |
| V | 1480 | 140 |
| W | 1210 | 95 |

As is evident from these results, the mechanical properties of the alloys according to the present invention are much more excellent than those of Comparative Alloys.

When Alloys J, K, U, V and W were respectively subjected to a cutting test under conditions using a workpiece of SNCM 8, cutting speed of 230 m/min, cutting depth of 2 mm, feed of 0.36 mm/rev and cutting time of 10 minutes, Alloys U and V exhibited respectively a flank were width of 0.36 mm and 0.15 mm, while Alloys J and K of the present invention exhibited respectively a flank wear width of 0.09 mm and 0.08 mm, being superior thereto in wear resistance. In measurement of the quantity of nose push at that time, Alloys J and K of the present invention were also more excellent in heat resistance strength and showed only little values, while Alloys U and V showed respectively 0.08 mm and 0.12 mm. When Alloys J, K, U and V were then subjected respectively to milling under conditions using a workpiece of SNCM 9 (sheet of 70 mm × 200 mm), cutting speed of 200 m/min, cutting depth of 5 mm, feed of 0.18 mm/rev and cutting time of 3 minutes, the number of thermal cracks were measured. Eight thermal cracks and 21 thermal cracks were respectively found in Alloys U and V, but only 2 cracks and no cracks were found in Alloys J and K. It is apparent from this result that the alloys of the present invention are very superior to Comparative Alloys in thermal crack resistance.

As to Alloy W, the cutting test was impossible due to its low hardness and bad transverse rupture strength.

What is claimed is:

1. A cemented carbonitride alloy comprising refractory metallic components and non-metallic components Table 1-continued

| Alloy of This Invention | Recipe of Composition (%) | | | | | | | | Proportion of Ta in W + Mo + Ta (atomic %) |
|---|---|---|---|---|---|---|---|---|---|
| | TiC | TiN | TaN | TaC | $Mo_2C$ | WC | Ni | Co | |
| Comparative Alloy | | | | | | | | | |
| O | 50 | 10 | — | — | 20 | 5 | 10 | 5 | |
| P | 60 | — | — | — | 10 | 15 | 7 | 8 | |
| Q | 45 | 15 | — | — | 10 | 15 | 7 | 8 | |
| R | 25 | 35 | — | — | 10 | 15 | 7 | 8 | |
| S | 51 | — | — | 12 | 10 | 12 | 7 | 8 | |
| T* | 17 | — | — | 10 | — | 64 | — | 9 | |

Note:
*correspond to P 10 grade cemented carbide

Table 2

| | Alloy of This Invention | | | | | | | Comparative Alloy | | | | | |
|---|---|---|---|---|---|---|---|---|---|---|---|---|---|
| | A | B | C | D | E | F | G | O | P | Q | R | S | T* |
| Transverse Rupture Strength ($Kg/mm^2$) | 158 | 168 | 178 | 185 | 170 | 168 | 161 | 148 | 138 | 152 | 95 | 145 | 150 |
| Hardness (VHN)** | 1560 | 1550 | 1560 | 1540 | 1550 | 1500 | 1560 | 1545 | 1470 | 1555 | 1310 | 1500 | 1560 |

Note:
*P 10
**Vickers Hardness Number

Table 3

| Alloy of This Invention | Wear Test | | Plastic Deformation Resistance -Nose Push- (mm) | Thermal Fatigue Resistance |
|---|---|---|---|---|
| | Flank Wear (mm) | Crater Depth (mm) | | |
| A | 0.10 | 0.04 | 0.03 | broken at 1200 cycles |
| B | 0.08 | 0.05 | 0.04 | broken at 1300 cycles |
| C | 0.10 | 0.04 | 0.04 | broken at 1500 cycles |
| D | 0.08 | 0.02 | 0.02 | broken at 1800 cycles |
| E | 0.09 | 0.03 | 0.02 | broken at 1700 cycles |
| F | 0.11 | 0.03 | 0.04 | broken at 1300 cycles |
| G | 0.10 | 0.02 | 0.03 | broken at 1400 cycles |
| Comparative Alloy | | | | |
| O | 0.09 | 0.02 | 0.02 | broken at 300 cycles |
| P | 0.10 | 0.03 | 0.18 | broken at 150 cycles |
| Q | 0.08 | 0.01 | 0.01 | broken at 400 cycles |
| R | stopped in 5 minutes due to large wear | | stopped due to large wear | broken at 20 cycles |
| S | 0.09 | 0.02 | 0.13 | broken at 300 cycles |
| T | 0.25 | 0.15 | 0.10 | broken at 1600 cycles |

Test Condition
Wear Resistance Test (Screw Cutting)
Workpiece: SCM 3H Hs = 38 ± 2, Diameter: 200 mm
V=200 m/min, d = 1.5 mm, f=0.36 mm/rev
T=10 min
Plastic Deformation Resistance Test (Screw Cutting)
Workpiece: SNCM 9H Hs=40±2, Diameter:200mm,
V=200 m/min, d=1.5 mm, f=0.36 mm/rev, T=30 sec
Thermal Fatigue Resistance Test (interrupted cutting)
Workpiece grooved: SCM 3H Hs 38 ± 2, Diameter: 100 mm,
V = 150 m/min, d=1.5 mm, f=0.59 mm/rev, T=until broken In Table 3, the thermal fatigue resistance test is carried out by forming a groove having a cross section of V-type on a workpiece in the longitudinal direction and subjecting to turning to thus give a cycle of heat and stress. When cutting is carried out in this cutting manner under the conditions shown in Table 3, there occur thermal cracks as a precursive phenomenon on a rake face at a certain time until a tool edge is broken down. When the cutting is further continued, the thermal cracks increase and connect each other up to breakage down. Therefore, the number of shock cycles up to breakage down correspond to the thermal fatigue resistance of a tool material.

It will apparently be understood from these results that the alloys of the present invention, A, B, C, D, E, F and G exhibit not only the similar thermal fatigue resistance to that of the P 10 grade cemented carbide alloy, but also an excellent wear resistance to cermets.

In comparison of Alloys D to F in which a part or all of tantalum is incorporated in the form of the nitride, the wear resistance and cutting fatigue resistance increase with the increase of the Ta to (W + Mo + Ta) atomic ratio as apparent from Table 2 and Table 3. Alloys D and E are more excellent in which the quantity of tantalum exceeds 40% by atomic ratio of the total quantity of tantalum, molybdenum and tungsten.

Furthermore, it is apparent from the comparison of the methods of adding tantalum that Alloy G in which all of tantalum is incorporated in the form of TaC is inferior to Alloys D and E but still superior to Comparative Alloy O.

EXAMPLE 2

The same raw materials as those of Alloy B in Example 1 were used. Firstly, TiC, TiN and TaN powders only were hot pressed at 1800° C for 30 minutes under for forming mainly a hard phase with an iron group metal for binding the hard phase, in which the refractory metallic components are titanium, tantalum, tungsten and molybdenum, the non-metallic components are nitrogen and carbon, the proportion of nitrogen being 5 to 40% by weight of the non-metallic components, the total amount of the non-metallic components being 0.8 to 1.0 times as much as that of the refractory metallic components by atomic ratio and the hard phase consisting of a carbonitride free from a phase consisting of tungsten carbide only and which alloy contains 3 to 25% by weight of the binder metal, at least 20% by weight of titanium, 5 to 40% by weight of tungsten and molybdenum, the ratio by weight of the sum of tungsten carbide and molybdenum carbide to all the carbides added as raw materials being less than 0.5, and 3 to 40% by weight of tantalum.

2. The cemented carbonitride alloy as claimed in claim 1, wherein the atomic proportion of tantalum to the total amount of tantalum, tungsten and molybdenum is in the range of 40 to 60%.

3. The cemented carbonitride alloy as claimed in claim 1, wherein 97 to 75% by weight of the hard phase and 3 to 25% by weight of the binder metal phase are present.

4. The cemented carbonitride alloy as claimed in claim 1, wherein the iron group metal is selected from iron, cobalt and nickel.

5. A process for the production of the cemented carbonitride alloy of claim 1, which comprises adding a part or all of the tantalum in the form of a nitride or carbonitride, which is free from molybdenum or tungsten, to other raw materials and then sintering the mixture.

* * * * *